US007731028B2

(12) United States Patent
Carroll, Jr.

(10) Patent No.: US 7,731,028 B2
(45) Date of Patent: Jun. 8, 2010

(54) SHIPPING PACKAGE SYSTEM FOR FRAGILE PANELS

(76) Inventor: Arch W. Carroll, Jr., 3265 Candlelight Trail, Marion, IN (US) 46952

( * ) Notice: Subject to any disclaimer, the term of this patent is extended or adjusted under 35 U.S.C. 154(b) by 570 days.

(21) Appl. No.: 10/653,318

(22) Filed: Sep. 2, 2003

(65) Prior Publication Data

US 2005/0045512 A1 Mar. 3, 2005

(51) Int. Cl.

| | |
|---|---|
| ***B65D 19/00*** | (2006.01) |
| ***B65D 85/48*** | (2006.01) |
| ***B65D 81/02*** | (2006.01) |
| ***B65D 85/30*** | (2006.01) |

(52) U.S. Cl. ..... 206/448; 206/583; 206/386; 206/591; 206/454; 229/939

(58) Field of Classification Search ..... 206/495, 206/497, 557, 560, 565, 449, 454, 595–598, 206/583, 591–594, 386, 585, 448; 53/461–463, 53/441, 450; 229/939

See application file for complete search history.

(56) References Cited

U.S. PATENT DOCUMENTS

| | | | | | |
|---|---|---|---|---|---|
| 1,676,238 | A | * | 7/1928 | Batty | 229/87.01 |
| 1,816,598 | A | | 7/1931 | Martin | |
| 2,005,967 | A | | 6/1935 | Berdan | |
| 2,740,518 | A | | 4/1956 | Kincaid | |
| 2,743,010 | A | | 4/1956 | Koester | |
| 2,873,024 | A | | 2/1959 | Koester | |
| 3,389,785 | A | | 6/1968 | Lidgard | |
| 3,403,778 | A | | 10/1968 | Voytko et al. | |
| 3,749,233 | A | | 7/1973 | McCormick, Jr. | |
| 3,764,002 | A | | 10/1973 | Spiegel et al. | |
| 3,853,220 | A | | 12/1974 | Luray | |
| 3,884,356 | A | | 5/1975 | Lidgard | |
| 3,885,667 | A | * | 5/1975 | Spiegel et al. | 206/478 |
| 3,891,090 | A | | 6/1975 | Spiegel et al. | |
| 3,921,890 | A | | 11/1975 | Reihm | |
| 3,992,849 | A | * | 11/1976 | Lett, III | 53/449 |
| 4,085,847 | A | * | 4/1978 | Jacalone | 206/600 |
| 4,747,486 | A | * | 5/1988 | Benno | 206/427 |
| 4,865,200 | A | * | 9/1989 | Sullivan et al. | 206/583 |
| 5,105,946 | A | * | 4/1992 | McDowell | 206/454 |
| 5,219,073 | A | | 6/1993 | Cowie | |

(Continued)

*Primary Examiner*—Mickey Yu
*Assistant Examiner*—Melissa L Lalli
(74) *Attorney, Agent, or Firm*—Woodard, Emhardt, Moriarty, McNett & Henry LLP

(57) ABSTRACT

A product vulnerable to damage during shipping, such as an automobile windshield glass, for example, is mounted on a support pad and fixed onto the pad by wrapping a stretch wrapping film around the combination of the pad and glass. The borders of the pad extend beyond the borders of the glass so the package containing the glass can be stood on edge, but the edge of the glass is spaced away from the surface on which the package is stood. Thus the glass, secured to the pad, is suspended away from that surface. Multiple packages can be packed into a shipping container and the loaded container can be lifted and transported by a lift truck with lifting forks received in passageways formed in the container by notches in the bottom edges of the support pads. The pads and containers are made of die-cut corrugated fiberboard material although other material might also be used in the practice of the invention.

46 Claims, 14 Drawing Sheets

U.S. PATENT DOCUMENTS

| | | | | | |
|---|---|---|---|---|---|
| 5,323,896 | A | | 6/1994 | Jones | |
| 5,605,229 | A | | 2/1997 | Sowa | |
| 5,676,245 | A | | 10/1997 | Jones | |
| 5,741,535 | A | * | 4/1998 | Cope et al. | 426/124 |
| 5,794,542 | A | * | 8/1998 | Besaw | 108/51.3 |
| 5,918,744 | A | * | 7/1999 | Bringard et al. | 206/596 |
| 5,934,473 | A | * | 8/1999 | Belshe | 206/583 |
| RE36,412 | E | | 11/1999 | Jones | |
| 6,158,589 | A | | 12/2000 | Smith et al. | |
| 6,289,655 | B1 | * | 9/2001 | Ridgeway et al. | 53/449 |
| 6,550,222 | B2 | | 4/2003 | DeGrasse | |
| 6,564,532 | B2 | | 5/2003 | Gutche | |
| 6,920,981 | B2 | | 7/2005 | Lofgren et al. | |
| 2004/0074798 | A1 | | 4/2004 | Taylor et al. | |
| 2005/0183978 | A1 | * | 8/2005 | Christensen et al. | 206/448 |
| 2008/0237088 | A1 | * | 10/2008 | Carroll | 206/583 |

* cited by examiner

SHIPPING PACKAGE SYSTEM FOR FRAGILE PANELS

BACKGROUND OF THE INVENTION

The present invention relates generally to packaging for shipment of products whose configurations have length and width that are large relative to depth, and more particularly to packaging such products which are made of materials or have construction features which are easy to break or otherwise damage in shipping operations.

Current bulk packaging of windshields for the automotive after-market trade is predominantly configured to hold twenty-five or more windshields. Such packaging involves construction of a wooden frame with corrugated fiberboard attached around the framing, along with several other packaging components to protect various fragile contact points of the individual windshields. A considerable amount of labor is required to configure the packaging for use by the manufacturer of the glass. The containers are required to be "pre-erected" and they present difficulties in the shipping and storage of empty containers.

SUMMARY OF THE INVENTION

One aspect of the invention provides means and method for protection of products individually during storage and shipment.

Another aspect is facilitating the standing of individual product containing packages on edge on a floor, a table, a "bulk pack" container bottom, or other supporting surface, but suspending the product spaced away from the supporting surface.

Another aspect of the invention provides a support pad shaped to facilitate placement of the product to be shipped, within the perimeter of the pad, and stretch wraps the product onto the pad with commercially available stretch film using the stretch and holding properties of the film and thereby secures the product in place on the pad within the perimeter of the pad.

Another aspect of the invention is that a single wrapped-product package can be placed in a container and shipped to a customer.

Another aspect is packaging a product so that a number of packages of individual products can be "collated" into a shipping container.

Another aspect of the invention is that shipping containers filled with a number of packages of individual products can be provided, using cohesive properties of stretch wrap film to add stability to such "bulk packs" without separators between the individual packages.

Another aspect of the invention is that a support pad and shipping container can be made of material "knocked down flat", and stored flat until the product to be shipped is manufactured and ready to pack out. At that time the pad and container materials can be erected for packaging the product.

Another aspect of the invention is provision of holes in shipping containers for entry of forks of lift trucks enabling the lifting, transportation and storage of loaded containers without separate pallets.

DESCRIPTION OF THE ILLUSTRATED EMBODIMENTS

Figure 1:
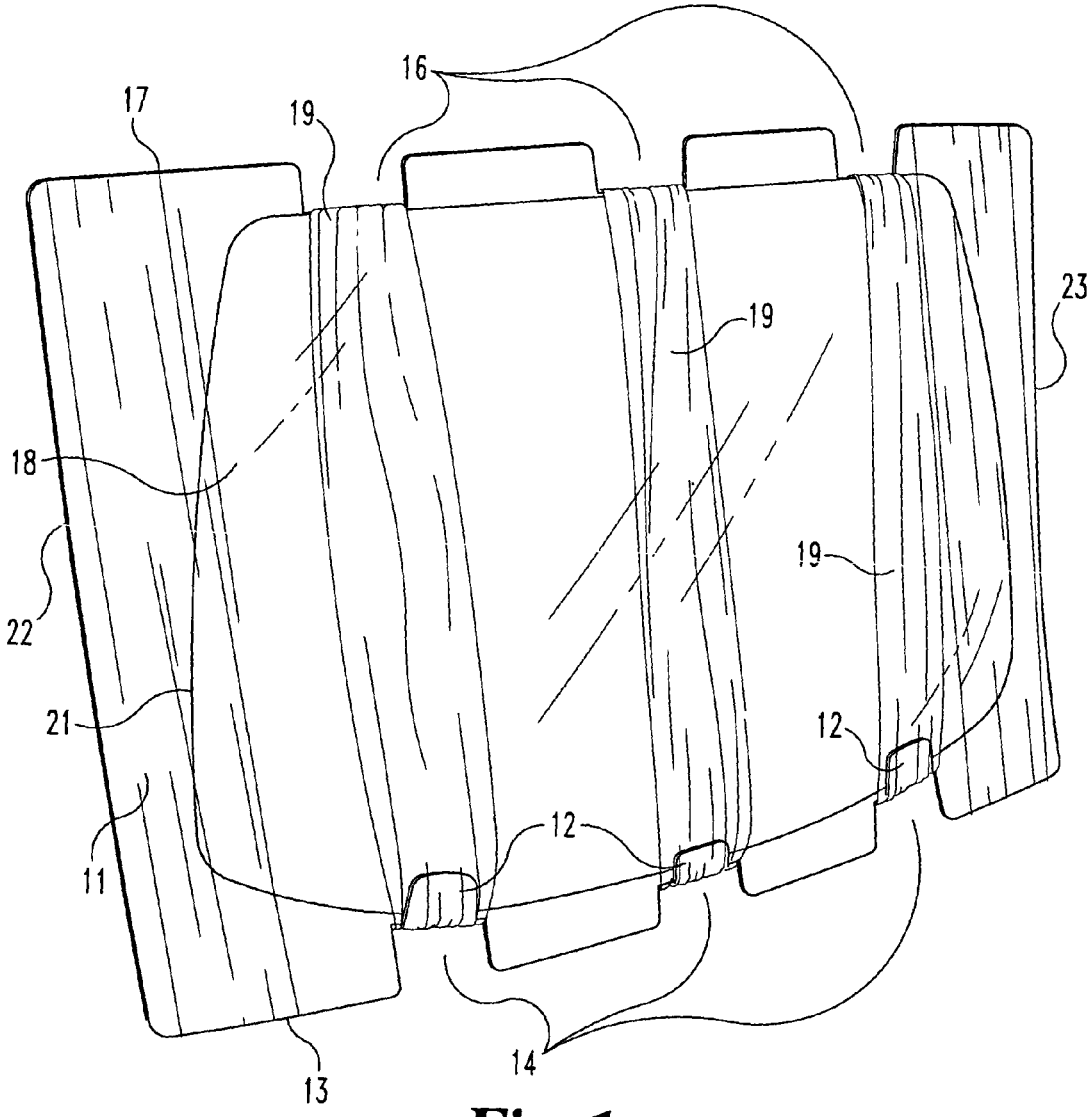
FIG. 1 is a front perspective view of a windshield package according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
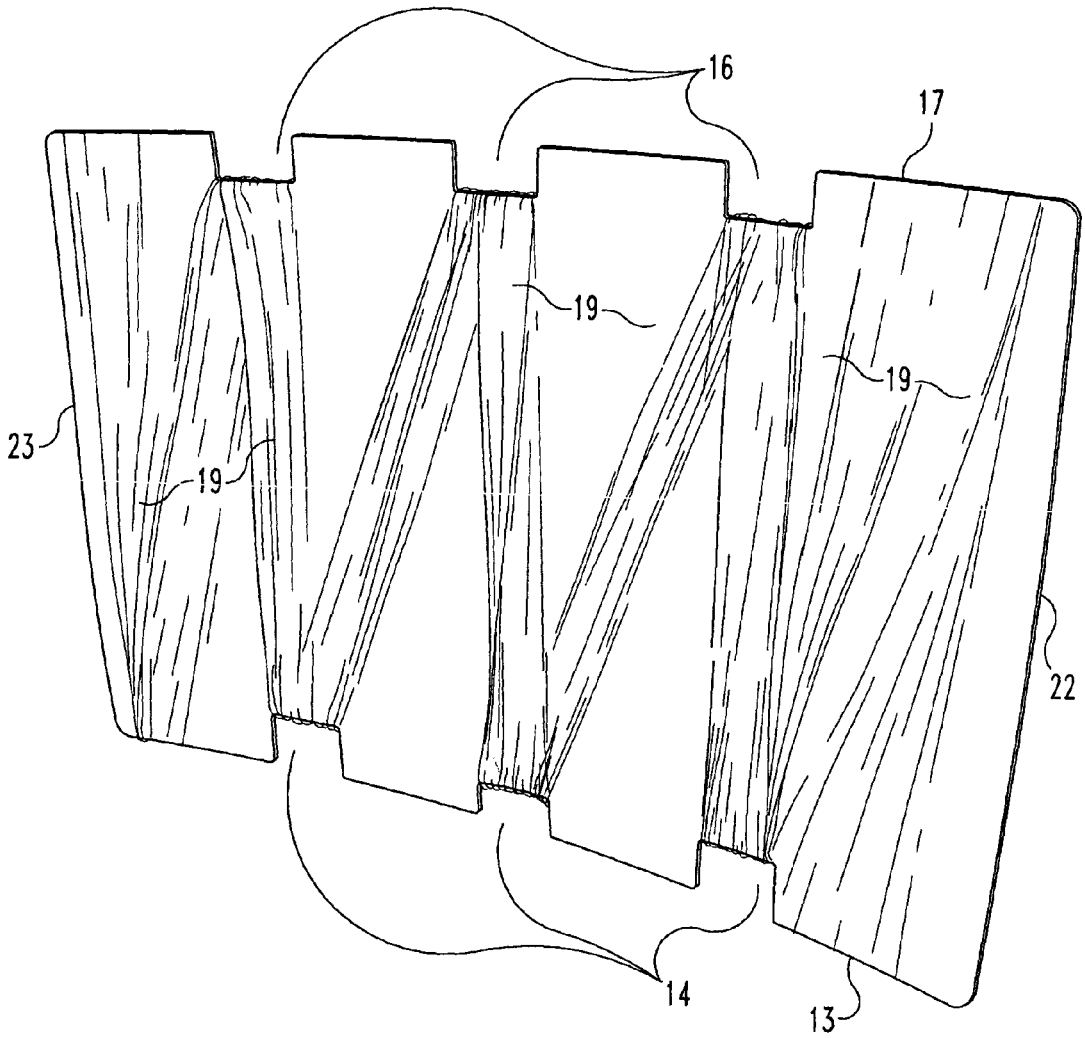
FIG. 2 is a rear perspective view of the package of FIG. 1.

Referring now to FIGS. 1 and 2, a package according to one embodiment of the present invention is shown. It includes a corrugated fiberboard pad 11 cut to provide three tabs 12 at the bottom edge 13 and which have been turned upward to produce notches 14. Similarly, three notches 16 have been provided in the upper edge 17. In these instances, instead of forming tabs at the notches, the material has been completely blanked out of the board.

A curved windshield 18 is mounted to the pad 11 and is secured to the pad by film stretch wrapped around the pad and the windshield as at 19. The wrapping material can be wrapped by machine or by hand, and the pattern can be random as long as there is control of location of the windshield on the pad so that the entire perimeter 21 of the windshield is well within the bottom and top edges 13 and 17 of the pad and the side edges 22 and 23 of the pad. The film wrapping through the notches and around the edge of the windshield at the top and around the tabs at the bottom is important. It is preferable that the wrapping from top to bottom is performed across the majority of the width of the windshield. While the wrapping from top to bottom notches can be parallel on either the front as shown in FIG. 1, or the back, it is preferable that there be continuous wrap from notches in the upper edge diagonally to notches in the lower edge on at least the front or the back and, preferably, on both front and back of the package. A combination of this angled wrapping with straight wrapping from top notch to bottom notch and from portions of the top edge other than notches, to portions of the bottom edge both notched and without notches, is shown on the backside of the pad in FIG. 2. So the stretch wrapping of the windshield is adequate to suspend the windshield on the pad with all features of the windshield edges well within the area defined by the perimeter of the pad. The upturned tabs 12 held in place by the wrapping may assist in supporting the weight of the windshield during the wrapping and subsequent handling and transportation.

Figure 16:
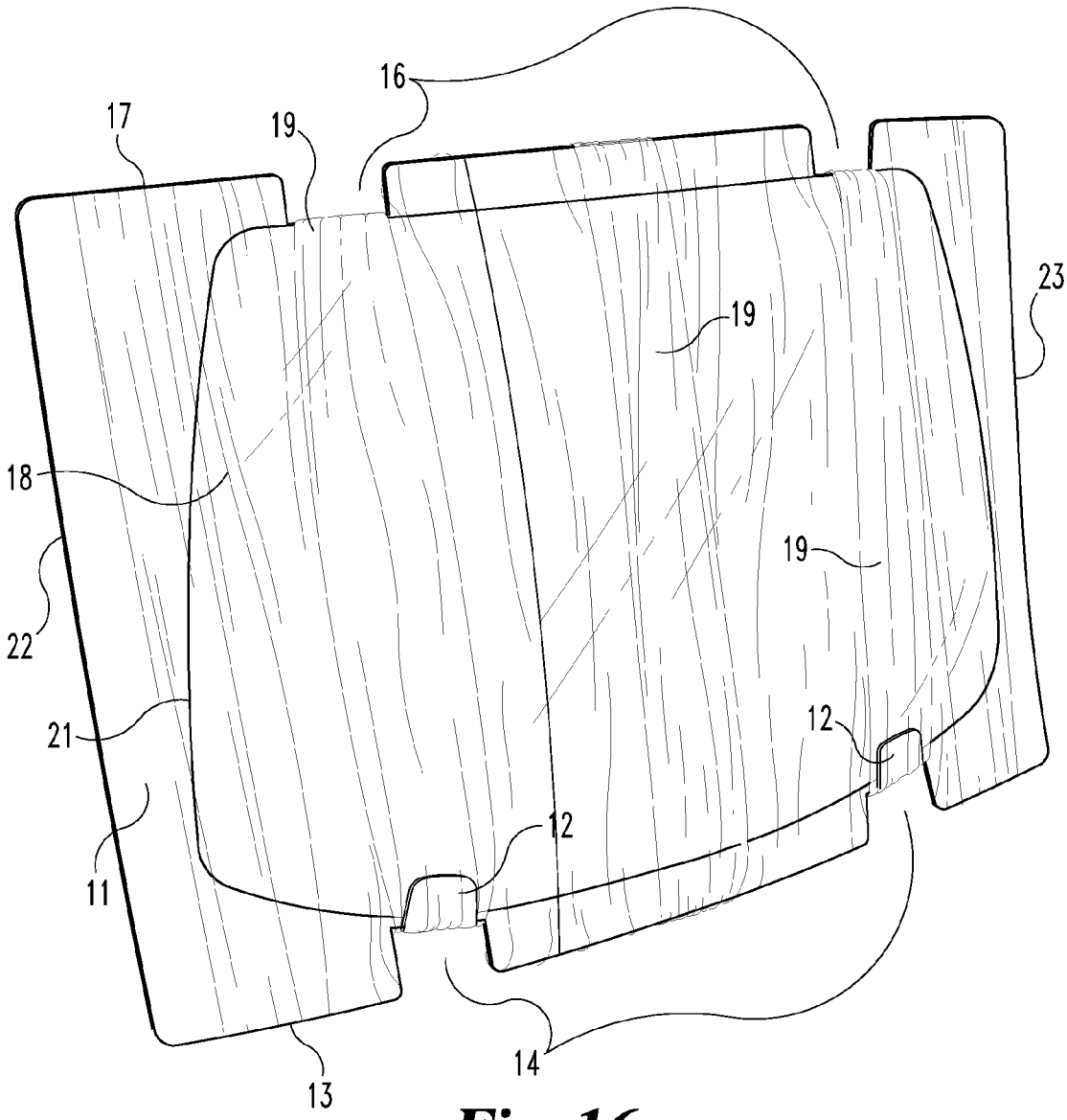
FIG. 16 is a front perspective view of a windshield package according to an alternative embodiment.

Referring now to FIG. 16, an alternate embodiment of the present disclosure is shown including curved windshield 18 mounted to pad 11 by film stretch wrapped around the pad and the windshield as at 19. The stretch wrapping is spread out over the whole width of windshield 18 and covers the entire perimeter of windshield 18.

Figure 3:
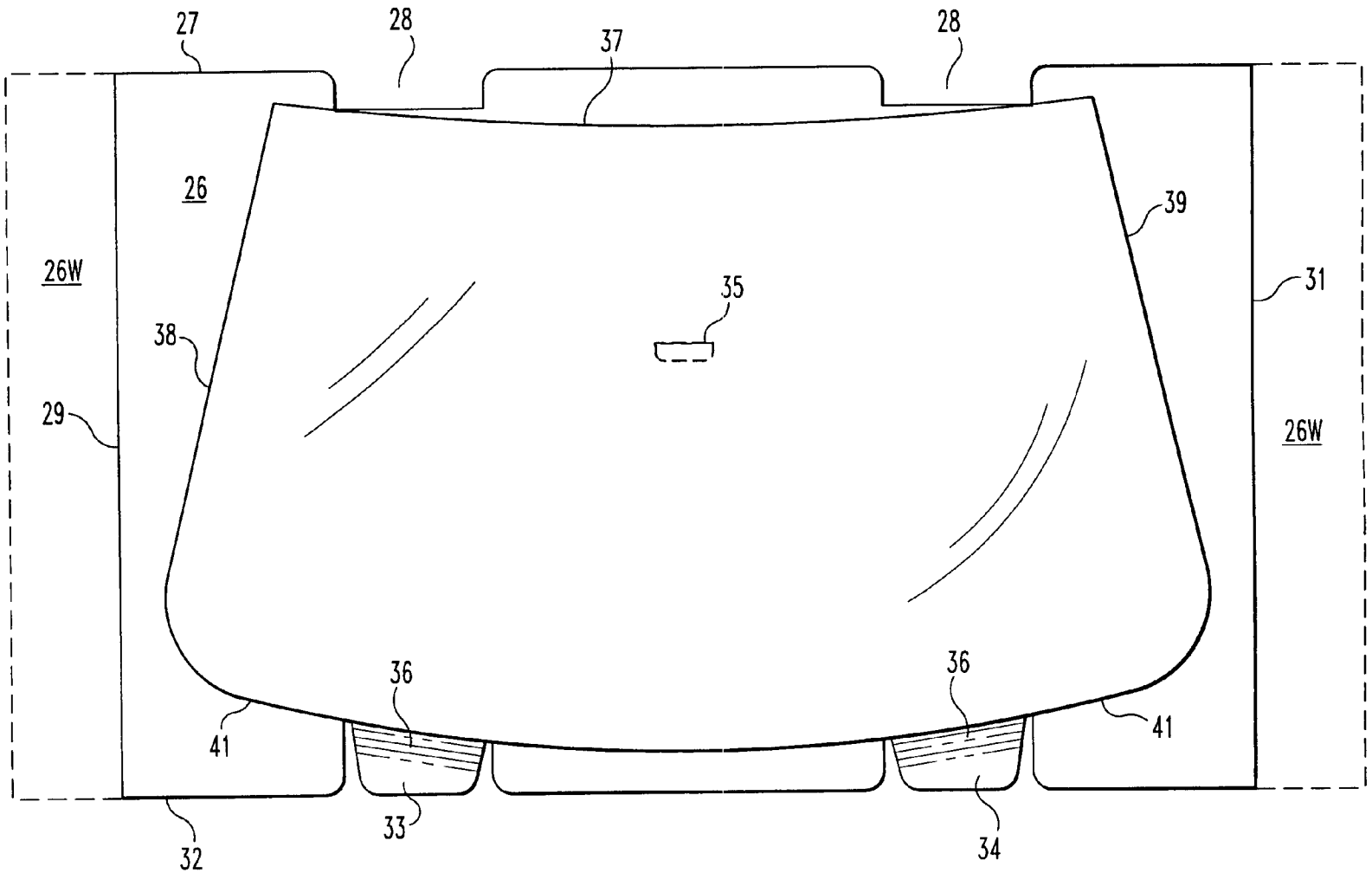
FIG. 3 is a front view of a pattern for a two-tab corrugated fiberboard blank for a windshield suspension pad according to another embodiment of the invention.

Referring now to FIG. 3, there is shown a drawing pattern for a die-cut pad 26 of 275 pound double-walled corrugated fiberboard material. Dimensions in inches are shown as an example. In the resulting die-cut pad, the top edge 27 has two notches 28 punched completely out. The side edges 29 and 31 are straight. The bottom edge 32 is notched at four places to form two tabs 33 and 34 with light score lines such as 36 to facilitate folding them forward. A hand hole 35 is blanked out of the middle. The printed outline of the windshield to be suspended on this pad is printed on the pad as shown at 37, 38, 39 and 41. This outline provides appropriate guidelines for the placement location of the windshield on the pad for stretch wrapping. Various other ways for proper product placement can be used. Another example is die cuts to produces holes, marks or tabs for orientation points. Of course such cuts can be provided at the same time that the pad is cut from stock.

Figure 4:
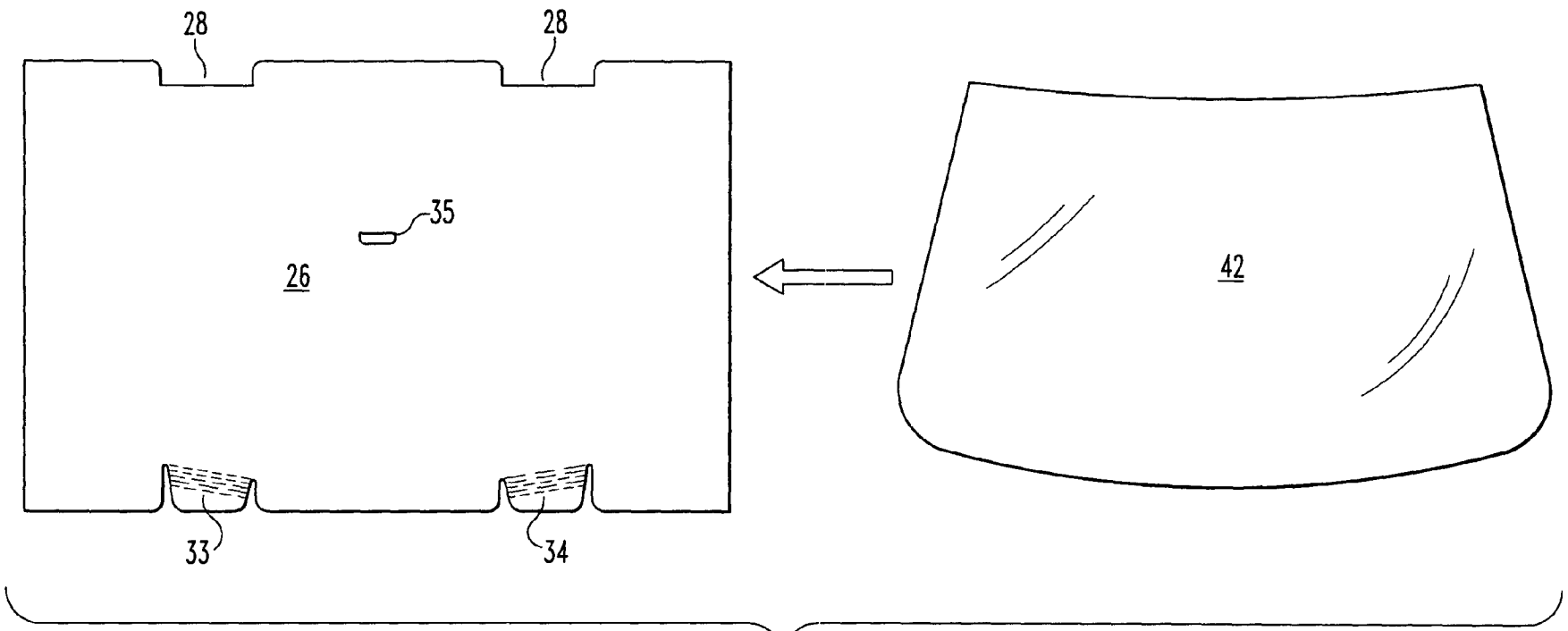
FIG. 4 is a schematic diagram showing a windshield about to be installed on a fiberboard blank according to the pattern of FIG. 3.
Figure 5:
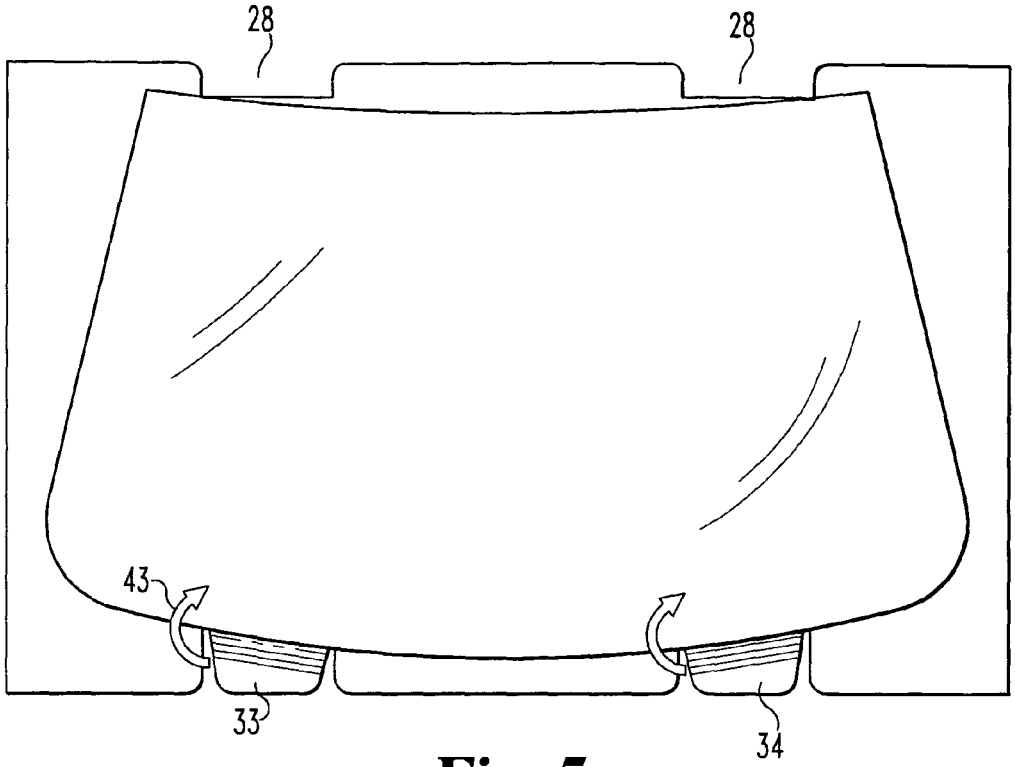
FIG. 5 is a view showing the windshield installed on the blank.
Figure 6:
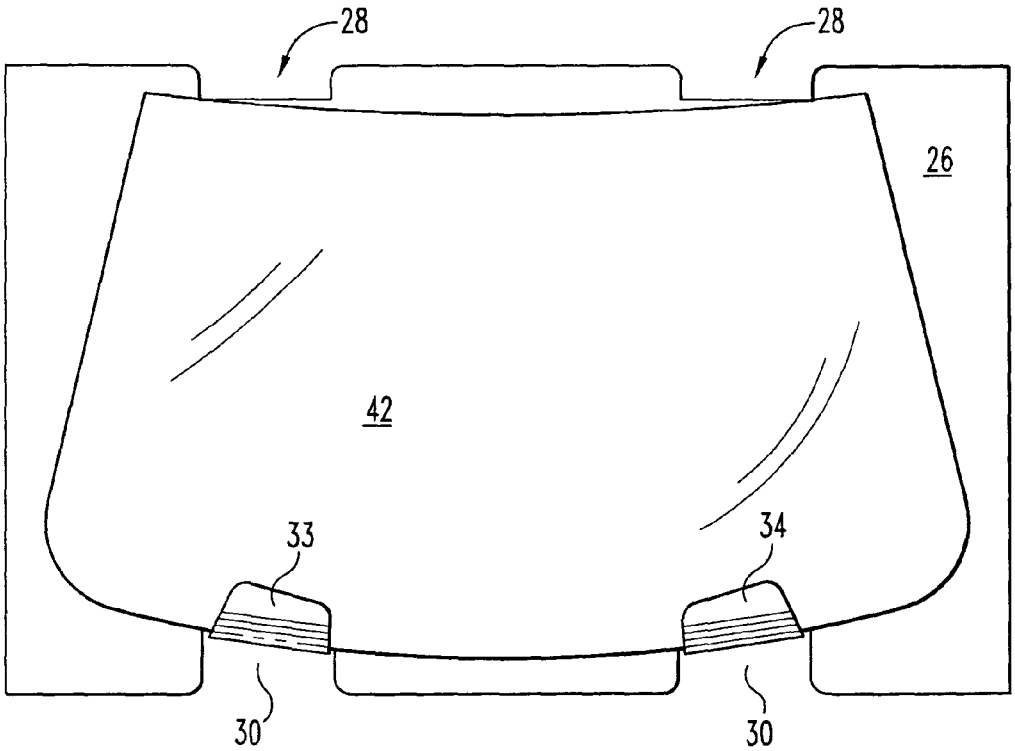
FIG. 6 shows the tabs folded up over the bottom edge of the windshield.

Referring now to FIG. 4, the blank 26 is shown ready for mounting the windshield 42 on it. The windshield is placed on the pad as shown in FIG. 5, and the tabs 33 and 34 are turned upward and forward in the direction of arrows 43 so that they overlap the front face of the windshield at the bottom edge as shown in FIG. 6. The score lines such as 36 on the pad 26 assure that when the tabs are bent forward and upward the windshield will be properly located with its lower edge overlying the pattern drawn or otherwise placed on the front of the pad 26.

Figure 7:
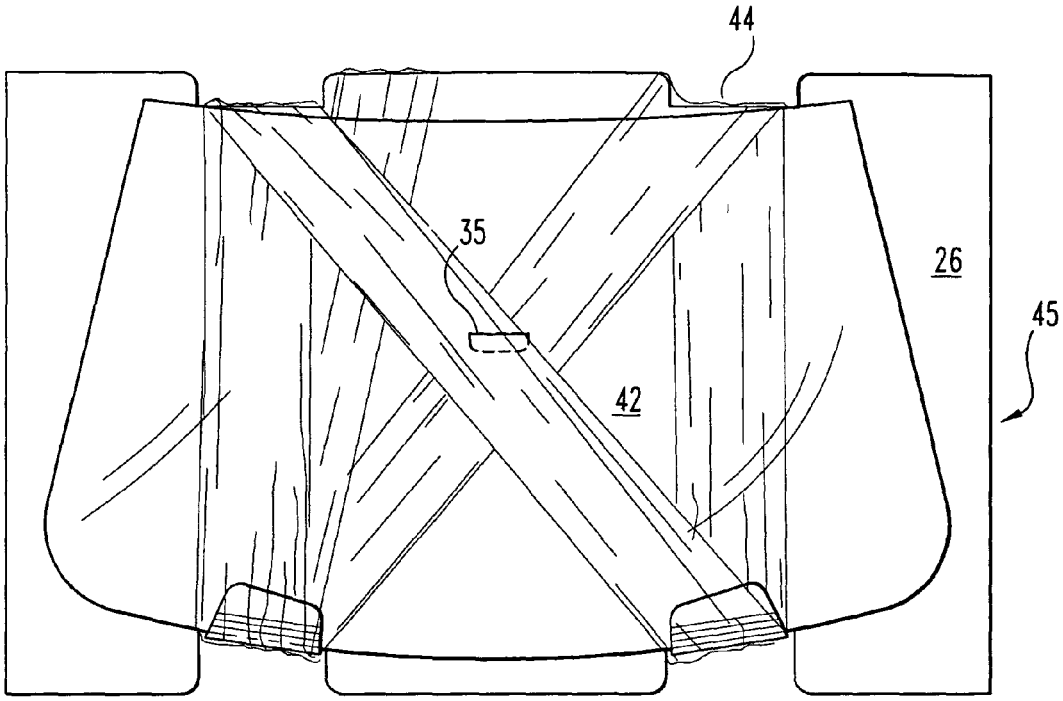
FIG. 7 shows the windshield and pad wrapped with stretch wrap film suspending the windshield on the pad and thus forming a windshield package.

When the windshield has been positioned such that it matches the pattern of lines, the stretch wrap film 44 is stretch wrapped around the pad and the windshield, with the film being wrapped through notches 28 at the top and around and covering the tabs 33 and 34 at the bottom, securely locating the windshield on the pad. Stretch wrap is continued as needed or desired around the front of the windshield and the back of the pad. When the amount of stretch wrapping has been completed to provide the degree of attachment and protection desired, the wrap film can be cut, and the end portion of the film adhered to the portion already wrapped, using the benefit of the cohesive nature of the wrapping film. If desired, the amount of wrap shown on the front of the windshield at FIG. 7, can be more than necessary to simply suspend the windshield securely on the pad, and/or can be spread out the whole width of the windshield, to serve additional useful purpose as will be described later herein.

Figure 8:
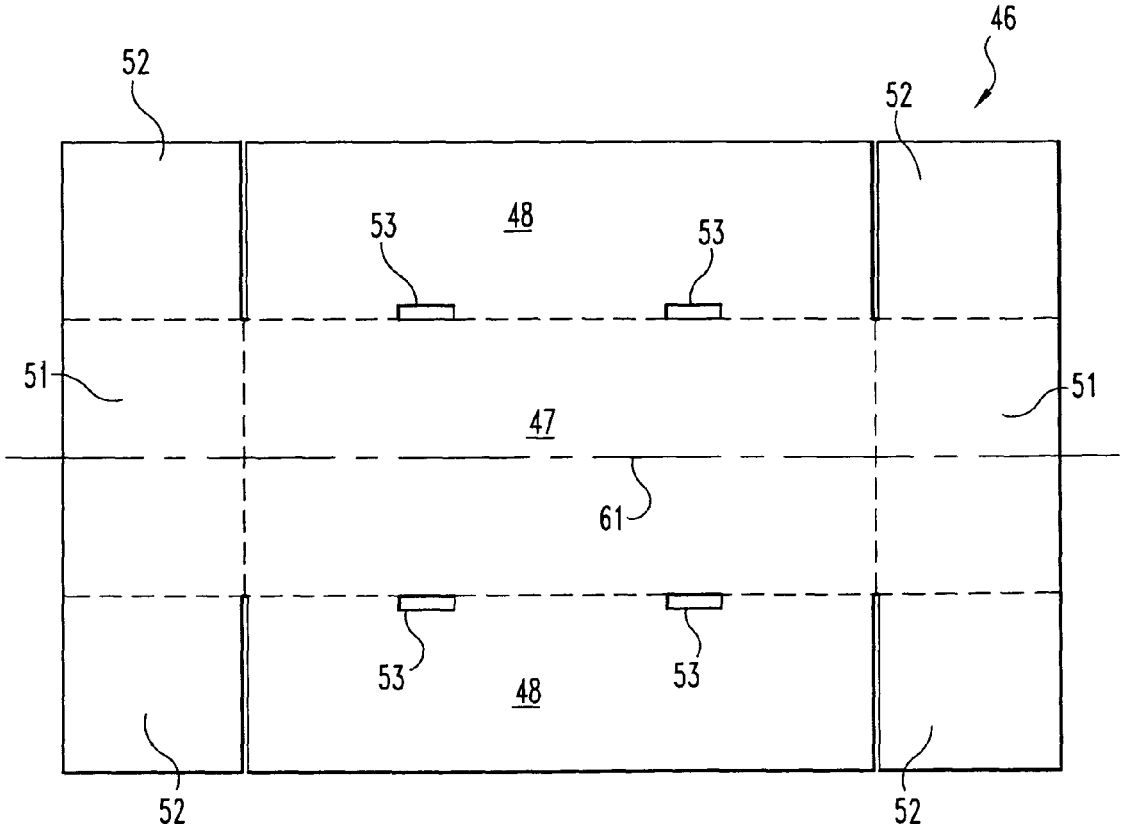
FIG. 8 shows a corrugated fiberboard blank for a snipping container bottom tray according to one aspect of the invention.
Figure 9:
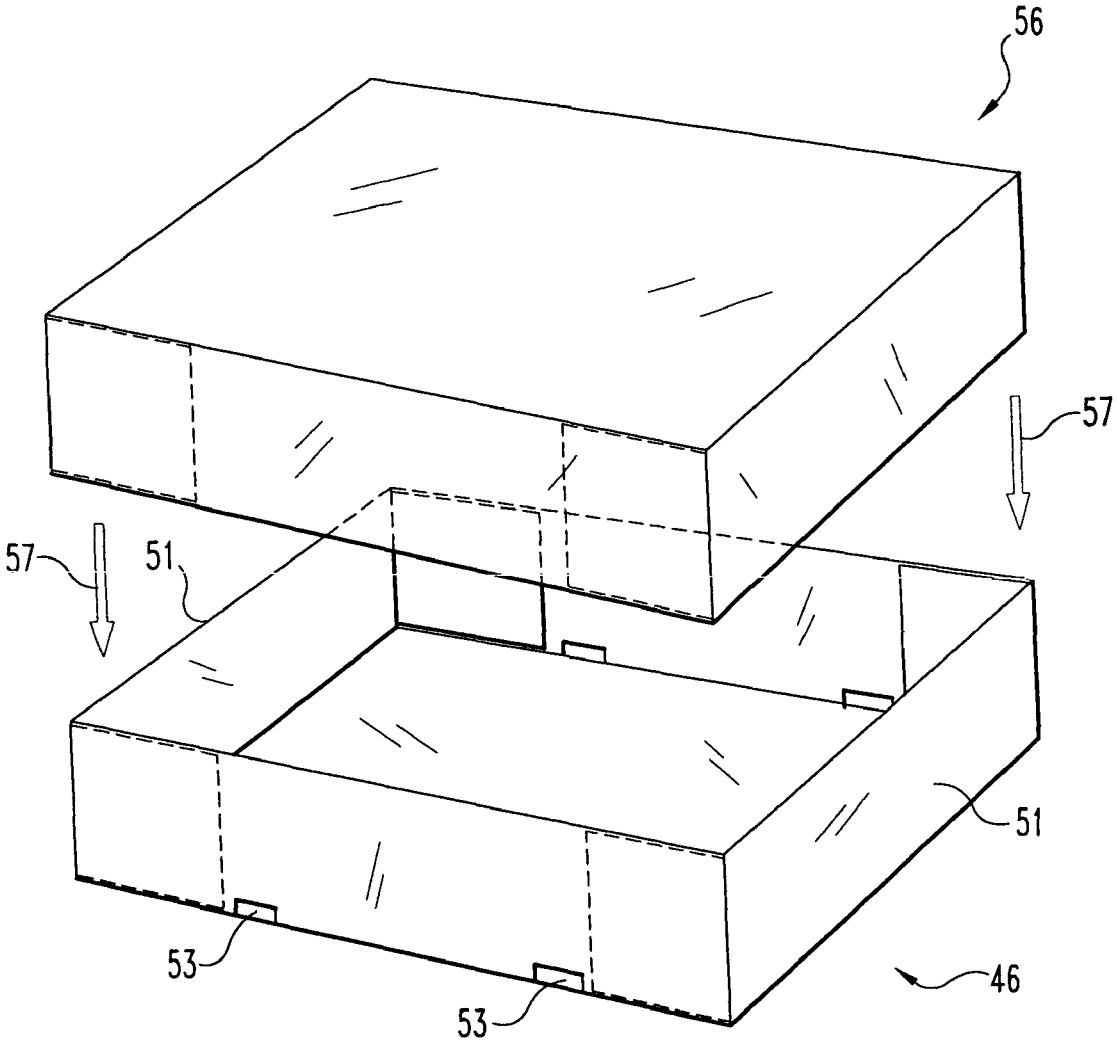
FIG. 9 shows the blank of FIG. 8 erected to form a bottom tray, and a similar blank erected to form a top tray or lid of the shipping container to be filled with the windshield packages.

Referring now to FIG. 8, a die-cut blank 46 of double wall. 275# corrugated fiberboard or any other appropriate strength material is shown for the bottom "tray" of a shipping container. It has the usual bottom panel 47 with sidewalls 48, end walls 51 and flaps 52 on the end walls. The sidewalls have holes punched at 53. This blank can be erected as shown in FIG. 9, gluing or otherwise securing the flaps 52 to the side walls in conventional fashion. A top 56 can be made according to the same form or pattern blank as for the bottom tray, but omitting holes 53, and made slightly larger than the bottom tray, to slide down on it in the direction of arrows 57 to close the shipper.

Figure 10:
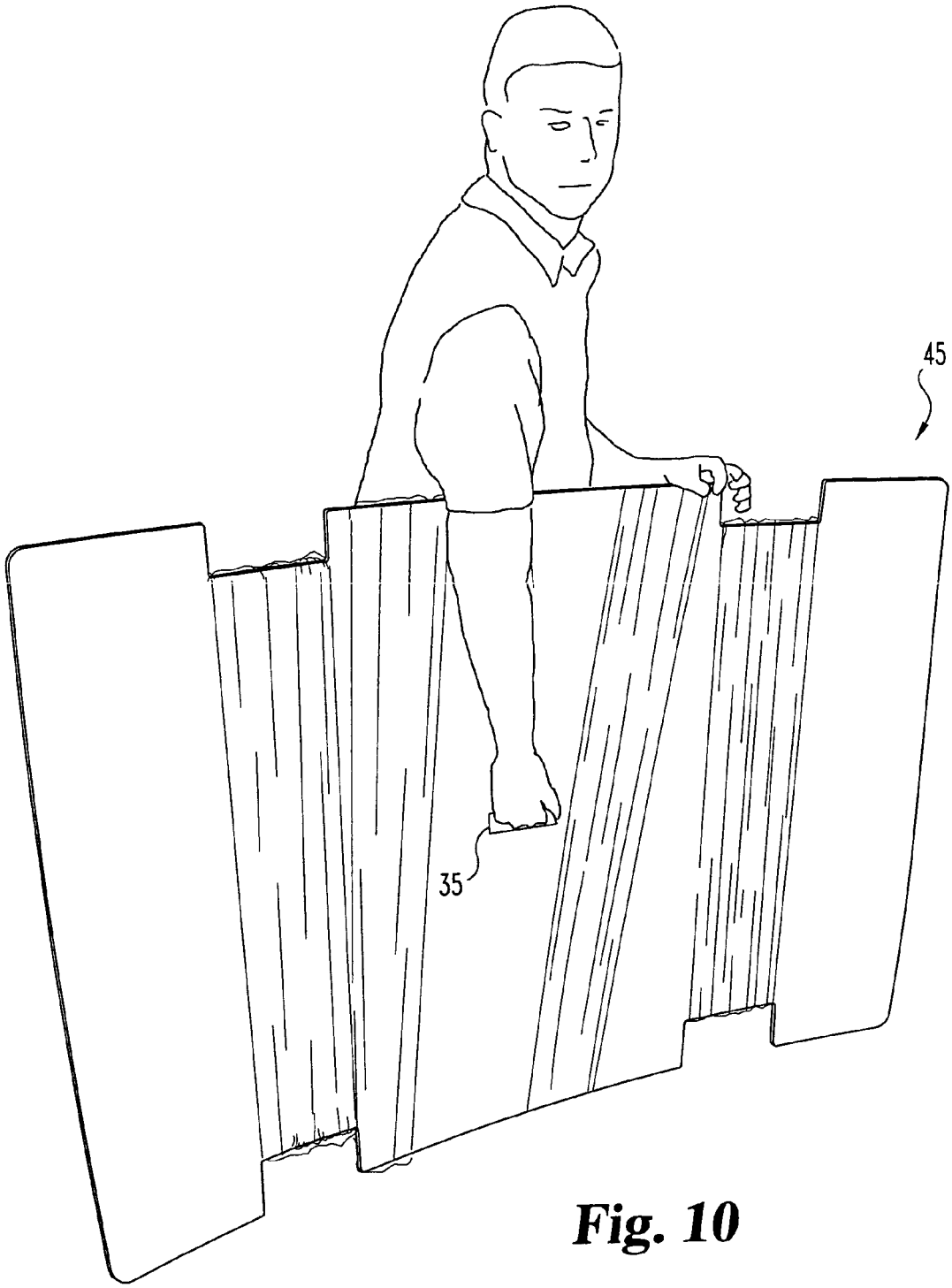
FIG. 10 is a view of the back of a package suspending a windshield therein and being carried conveniently by a worker.
Figure 11:
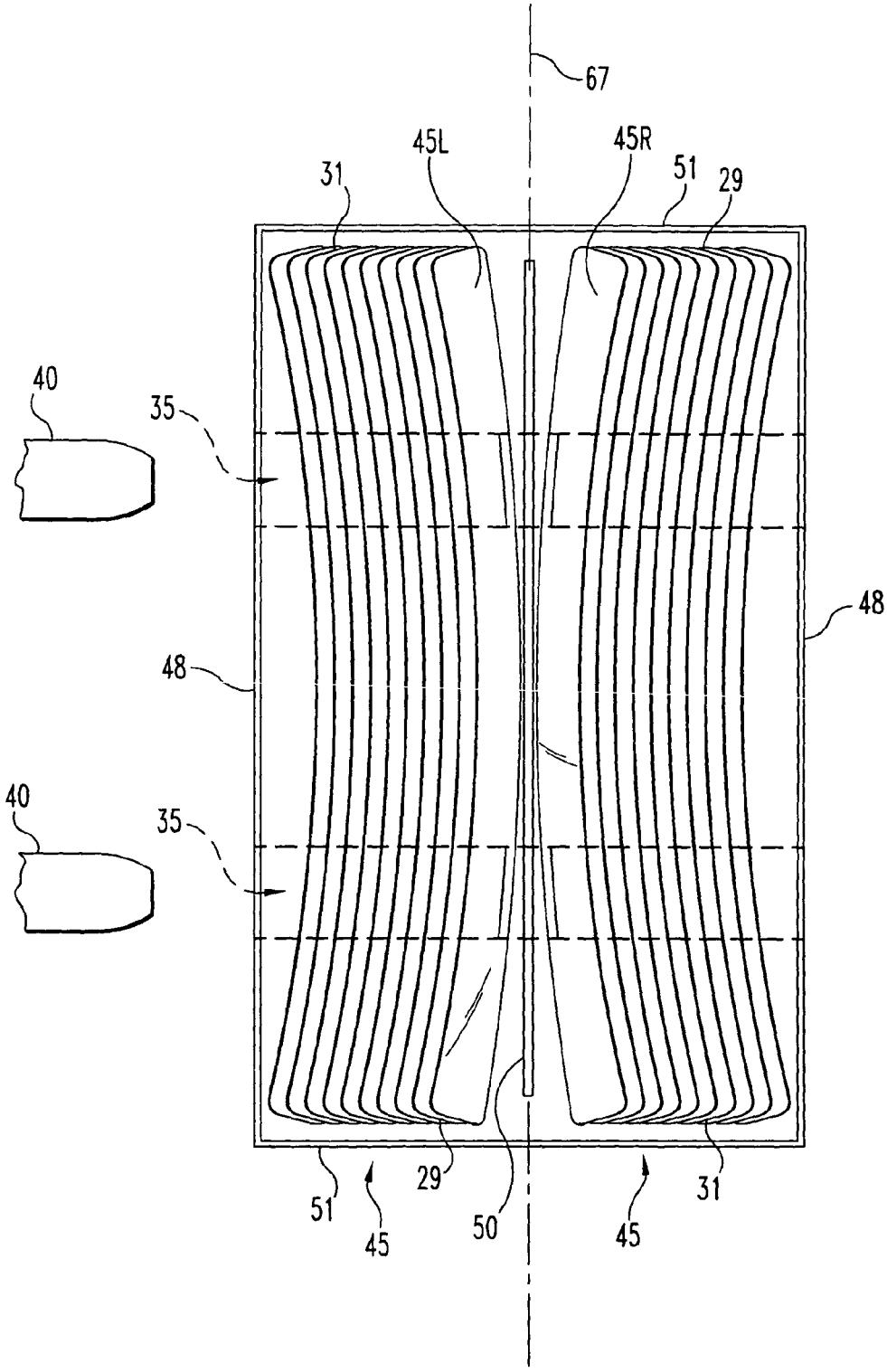
FIG. 11 is a top view of a plurality of such packages arranged in an X-shaped configuration in a container bottom tray.
Figure 12:
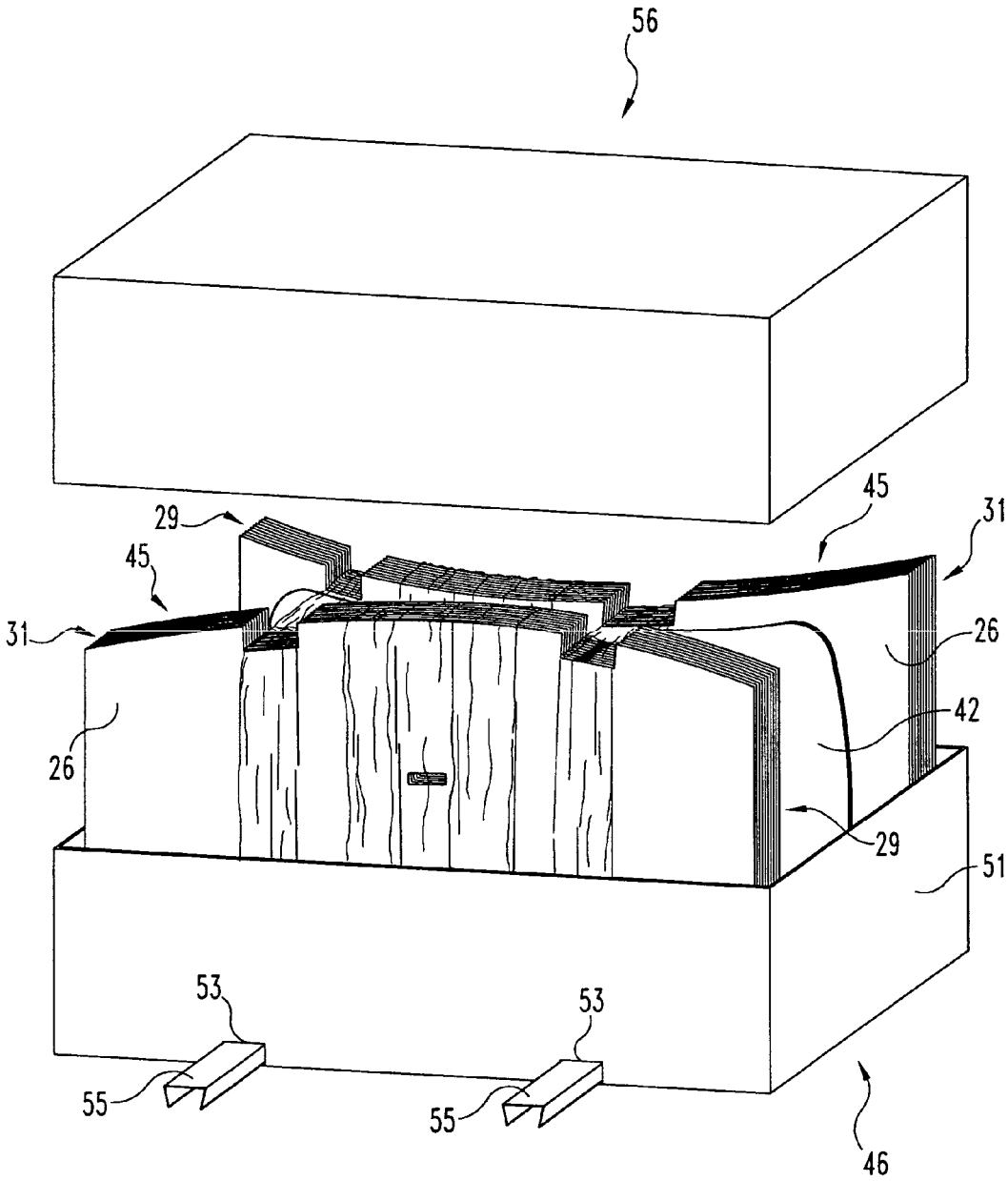
FIG. 12 is a perspective view showing the packages in a shipping container ready for installation of the top.

Prior to closing the shipper, it is filled with window packages such as described above with reference to FIGS. 3-7. After wrapping the window, the wrapped window package 45 (FIG. 7) can be picked up and conveniently carried by the worker standing at either the front of the wrapped windshield and pad, or at the rear, and inserting a hand in the hand hole 35 as shown in FIG. 10, and picking up and carrying the windshield to the shipper tray 46 and placing the windshield in the tray with the bottom edge 32 of the pad resting on the bottom 47 of the tray. Since the windshield is curved, the wrapping with stretch wrap imparts a curve to the pad. Such curve is shown in FIGS. 1, 2, 11 and 12 where the pad forms a planar curve that substantially conforms to the periphery of the windshield's concave back surface. Therefore, the windshields will be placed in the tray in an "X" configuration as shown in FIGS. 11 and 12. By placing them in this configuration, instead of nesting all windshield packages in one orientation, half of them are oriented in one direction and the other half in the other direction. Therefore the convex front surfaces of all of the packages face inwardly toward the center plane 61 (FIGS. 8 and 11) of the container. The two windshield packages 45L and 45R at the center of the container could have their convex front faces in abutting relationship. Therefore, it may be desirable that the wrapping for these two packages be extra thick to prevent any left to right (FIG. 11) shifting of the packages. Alternatively, and more likely than extra wrapping on center packages, some packing material can be placed between these facing windshield packages 45L and 45R. An example is one double wall panel 50 of corrugated fiberboard. The rest of the packages nest. The side edges 29 and 31 of the pads are close enough to the end walls 51 of the tray that there is no shifting sideways of the windshields within the tray.

Figure 13:
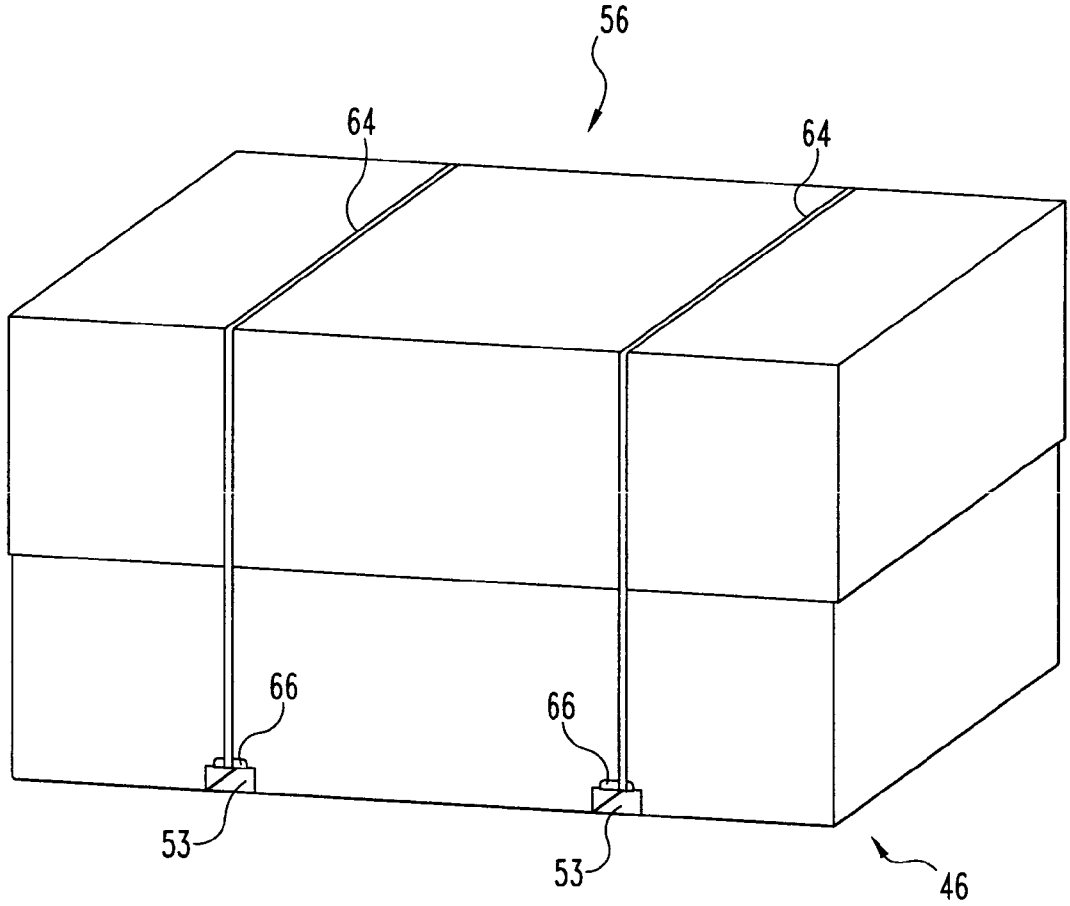
FIG. 13 shows the container closed and strapped closed.
Figure 14:
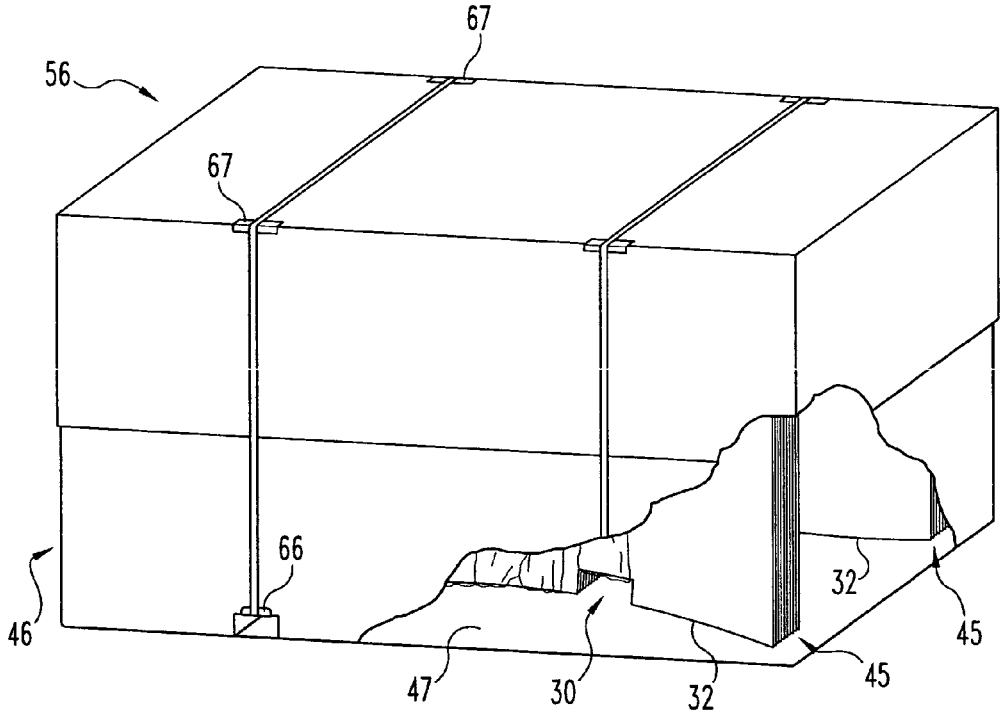
FIG. 14 is similar to FIG. 13 but with a portion broken out of the corner to show the pads mounted directly on the floor of the container and with the bottom notches in the pad oriented for access by the lifting forks of a lift truck.

Bottom notches 14 were mentioned with reference to the embodiment of FIGS. 1 and 2. Similarly, there are the bottom notches 30 in the pads of the illustrations of the two-notch embodiment of the FIGS. 3-7 and 10-14. According to another feature of the invention mentioned with reference to FIG. 8, there are four holes 53 in the sidewalls 48 of the bottom tray 46 of the container. As best shown in FIG. 14, the bottom edges 32 of the pads rest on the floor 47 of the tray 46. The top of each of the notches 30 is spaced above the tray bottom 47. The holes 53 are aligned with the notches in the pads, all of which are aligned in two rows 35 (FIG. 11) when the containers have been packed with the packages 45. The holes 53 provide access to the lifting forks 40 of a fork lift truck. Thus, it is possible to use the packed containers according to the present invention, without pallets, because the forks of the lift truck can enter the access holes 53 and pass through notches 30 under the windshields and lift the whole shipper and transport it as needed. The upturned tabs 34, and stretch wrapping around them, provide protection for the pads and the suspended windshield glasses. If further protection is desired to assure prevention of edge crush of the pads by lifting forks at notches 30, some tubes or downwardly opening channels made of corrugated fiberboard or other material can be placed from the access holes 53 in one tray wall and extend through the passageways formed by the bottom notches 30 of the pads to the access holes in the opposite wall of the tray. An example of such channel is shown in FIG. 12 where two such channels 55 are shown partially inserted into the two passageways 35 (FIG. 11) formed by the two notches 30 each, of all of the pads in a filled container bottom tray. This is a way that, if needed or desired, additional protection can be provided in the tops of the passageways formed by the notches 30 in all of the window packages from one of the walls 48 through the container to the other wall 48. After a container is filled, the lid 56 can be installed and can rest on the upper edges 27 of the suspension pads and strapped closed by poly strapping 64 in two places, running through the access holes 53, and under the pads through the notches 30. If desired to preclude any edge crush by the strapping 64, some tabs 66 of fiberboard or other material can be folded around the upper edges of the holes 53 as shown in FIG. 13. Similar protection can be provided at other locations such as 67. Packaging according to the present invention may be done by performing the stretch wrapping by hand. But various stretch wrapping machines are known. Examples are referenced in U.S. Pat. Nos. 6,564,532 and 6,550,222, and the references cited therein. Another is the "Yellow Jacket 110" which is a horizontal stretch wrapping machine by Wiley Metal, of Marion Ind., U.S.A. So the product and pad can be stretch wrapped by machine, if desired.

The packaging of automotive window products individually and "collating" a number of the packages into a shipping container can have real advantages over conventional practices. It allows safer and easier handling of individual glass components, as the stretch wrapping can be extensive enough, if desired, to cover the entire perimeter of the glass and thereby preclude encounter of any edge of glass by a worker while loading the packages into a shipping container. Additionally, the cohesive properties of the stretch wrap film, as one package nests against another, can lend stability to the bulk packs of multiple packages, by virtually eliminating the tendency of windshields to "shingle", i.e. slide out of the bottom of current conventional packaging. It can also reduce the incidence of damage in transit.

In the foregoing description, the illustrated embodiments show forwardly and upwardly turned bottom tabs on the pad. The weight and application of the product to the pad can have a bearing on whether it is desirable or necessary to use tabs at the bottom or at the top (at the location of the notches 28) or both bottom and top, or not at all. If the glass or other product to be suspended to a pad according to the invention is relatively flat, it may be desirable to have notches in the side edges of the pad as well as in the top and bottom, and stretch wrap film around the product, not only in and through the notches in the top and bottom edges, but also in and through notches in the side edges.

It should be understood that the invention can be employed using suspension pad materials other than 350 pound, double walled corrugated fiberboard. It depends on the nature and weight of the product to be suspended. Since the space requirement of the suspended product is usually significantly greater in length and width, than in thickness, it is usually suspended such that the package will be packed on edge in the shipper. Therefore the fiberboard will be oriented with the flutes running vertically to provide the needed vertical column strength. It is conceivable that a pad with only one facing secured to the corrugated media, might be sufficient in some applications.

It is also conceivable that the pad be made of material other than corrugated fiberboard. A plastic or metal might also be used. Desirability and height of stacking containers in warehouses or vehicles, weight and nature of the packaged product, and other considerations could dictate features of pads made of other materials, to provide the necessary column or top-to-bottom stacking strength of the pad. For example, if plastic were used, it might be necessary to have a corrugated component. Another consideration is the condition of the surface of the pad material, which is contacted by the product to be suspended. It cannot be abrasive, if abrasion of the product portion in contact would be detrimental to the needed appearance or performance of the product. Otherwise, it may be necessary to stretch wrap portions of the pad before placing the product on the pad, so that the stretch wrap film will protect the pad-engaging portions of the product from abrasion, and then wrap the product onto the pad. Alternatively, a non-abrasive coating can be provided on the front of the pad where the product will contact it.

The thickness of the wrap film used depends on what is necessary to get a snug covering of the product on the pad. Where the product will be machine-wrapped onto the pad, film selected will be dictated largely by optimum effectiveness of performance of the wrapping machine.

If, instead of bulk shipping of ten to thirty or more packages, only one package is to be shipped, a simple container can be employed. If the product is curved, as for a windshield or backlight (back window), the corners may appear to be more vulnerable than inboard portions of the window. Dunnage can be placed in the container if desired so that the corners of the pad remain properly situated in the corners of the container. The corners of the glass, being well inboard from the corners of the container, are well protected. If desired, instead of adding dunnage, pad extension panels or "wings" 26W (FIG. 3) can be provided by scoring or creasing the pad at locations 29 and 31. This will allow the panels to be folded forward at a ninety-degree angle from the plane of the face of the pad and extend across the width or short dimension of the shipping container. The short dimension will be relatively small, as the container is containing only one product package. Therefore the extension panels locate the pad in the container not only side-to-side, but also front-to-rear and, with the back of the pad located against the back of the container, and corners of the product touching or near the front of the pad, the edges and corners of the product are kept away from the front of the container.

In the description above, the packaged product has been made of glass. The invention is useful for the packaging and shipping of a variety of other products, where the product is three dimensional but the x-axis and y-axis dimensions are significantly greater than the z-axis dimension. Frequently, for various reasons such as, for example, convenience in removal of a certain package from a group, or to avoid warp, it is preferred to pack, store and ship the products oriented on an edge, like books in a bookcase. In the above examples, the side-to-side (x-axis) and top-to-bottom (y-axis) dimensions are significantly greater for the curved windshield than is the maximum dimension on the front-to-back (z-axis) i.e. the distance between imaginary parallel planes, one of which touches the most forward point of the glass and the other of which touches the most backward point of the glass.

Figure 15:
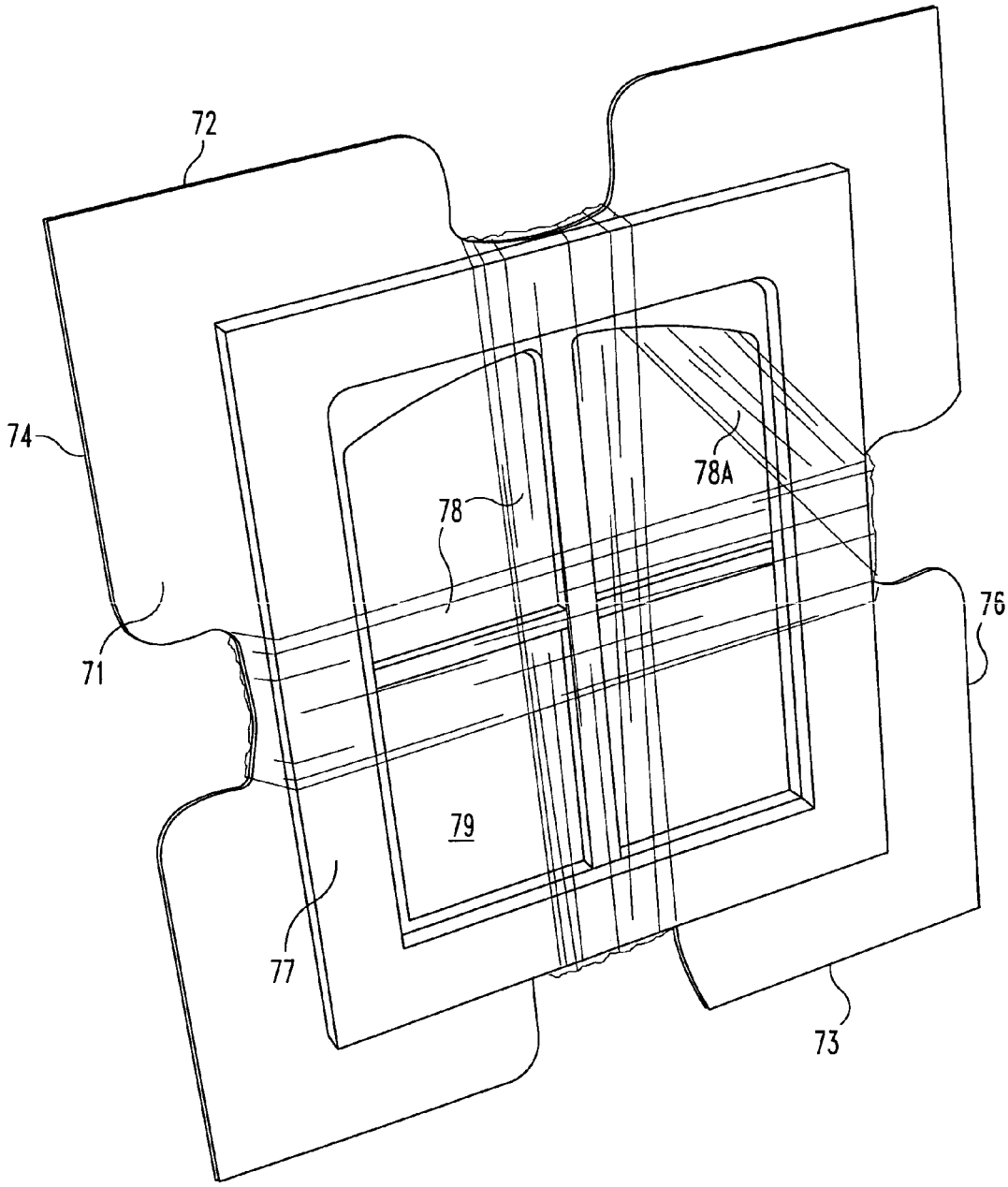
FIG. 15 is a front perspective view of a cabinet door package prepared according to an embodiment of the present invention.

Another product having such high and wide relative to front-to-rear dimensional relationships is shown in FIG. 15. It is a furniture cabinet door, with a glass window in it. Although the door without the window, might not be considered fragile, it is desirable it not be damaged in packaging or shipping. The present invention avoids risk of damage that could occur on the bottom edge if the door were resting on that edge. So referring to FIG. 15, the pad 71 of corrugated fiberboard has top, bottom, left and right edges 72,73,74 and 76, respectively. Each of these edges has a notch in it. The cabinet door 77 is suspended on the pad by stretch wrapping stretch wrap film 78 from top to bottom edge notches and side to side edge notches as shown. The wrapping in the front envelops the door and pad at the front, and crosses in the front and back in whatever is found most convenient for the wrapping personnel or wrapping machinery used. Since a single continuous length of film 78 can be used in this example as in the above-described examples, portions of the wrap can be at angles between notches as at 78A in front or in back or both, whatever is convenient and sufficient to hold the door snugly against the pad and within the perimeter of the pad. In any case, the entire perimeter of the door is within the entire perimeter of the support pad, even considering the notch contour as part of the perimeter of the pad. Pad and wrapping technique can be tailored to the particular product to be suspended. In any case, the weight of the product is not transmitted directly from a portion of the product to any portion of the container in which it is shipped. The product is suspended on the pad, and the weight is transmitted through the pad to the container, thus protecting the product from damage. Of course the window 79 in the door is amply protected.

The pad for the package of FIG. 15, with the single notch in each edge, results in a sort of clover shaped pad. Multiple side edge notches and top and bottom edge notches can be provided if desired for best product suspension, depending on the nature of the product packaged.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow.

What is claimed is:

1. A cargo shipping apparatus, comprising:

a container having a bottom tray and a top lid, the tray having a rectangular bottom surface and upstanding parallel sidewalls and upstanding parallel end walls;

said top lid having a rectangular top and parallel sidewalls and parallel end walls projecting downward from the top;

a plurality of packages, each package in the plurality of packages comprising:

a support having a front face and a rear face, and having a perimeter including top and bottom edges and left and right side edges;

said support having at least one lower notch in the bottom edge and at least one upper notch in the top edge;

a curved glass panel suspended on the front face of said support within the perimeter of said support, said curved glass panel having a concave back surface;

stretch wrapping film received in said notches; and said wrapping film stretched between said notches, around at least a portion of the support, around at least a portion of said curved glass panel, securing said curved glass panel to the front face of said support and imparting a planar curve to said support that substantially conforms to the periphery of the concave back surface;

wherein the bottom edges are supported by the bottom surface of the tray and the left and right side edges are proximate to the end walls of the tray and wherein the plurality of packages are nested in an "X" configuration wherein half of the packages are oriented in one direction and the other half in the other direction.

2. The package of claim 1 and wherein:

said support has at least three lower notches and at least three upper notches.

3. The package of claim 1 and wherein:

the support has ledges formed of the material of said support and projecting in a direction from the rear face toward the front face near the bottom edge of the support, and the ledges support said curved glass panel.

4. The package of claim 3 and wherein:

said support is made of corrugated fiberboard and said ledges are tabs formed from cuts in the bottom edge of the support and bent in a direction from the rear face of the support toward the front face of the support.

5. The package of claim 4 and wherein:

said curved glass panel has maximum x-axis, y-axis and z-axis dimensions, each of the maximum x-axis and y-axis dimensions being greater than the maximum z-axis dimension.

6. The package of claim 4 and wherein:

said curved glass panel is a window for a vehicle.

7. The package of claim 1 and wherein:

substantially the entire periphery of said curved glass panel is attached to said support.

8. The package of claim 1 and wherein:

the periphery of said curved glass panel is located proximate to said at least one lower notch and the periphery of said curved glass panel is located proximate to said at least one upper notch.

9. The package of claim 1 and wherein:

said support has two lower notches, each of the lower notches being of appropriate size to accommodate lifting forks of a fork lift truck.

10. The package of claim 1 and wherein:

said support is made of corrugated fiberboard oriented with the flutes running substantially perpendicular to said top edge and said bottom edge.

11. The package of claim 1 and wherein:

said wrapping film contacts a majority of the width of said curved glass panel.

12. The package of claim 1 and wherein:
said wrapping film is a continuous wrap.

13. The package of claim 1, wherein said wrapping film is wrapped from top to bottom across a majority of the width of the curved glass panel.

14. The package of claim 13, wherein said wrapping film covers the whole width of the curved glass panel.

15. The package of claim 1, wherein said wrapping film covers the entire perimeter of the curved glass panel.

16. The package of claim 1, wherein said support is made of a corrugated fiberboard oriented with flutes running substantially parallel to the axis of curvature of said planar curve.

17. The package of claim 16, wherein said flutes run substantially perpendicular to said top and bottom edges, and the majority of the length of said top and bottom edges are substantially free of scoring or creasing.

18. A cargo shipping apparatus comprising:
a container having a bottom tray and a top lid, the tray having a rectangular bottom surface and upstanding parallel sidewalls and upstanding parallel end walls;
the lid having a rectangular top and parallel sidewalls and parallel end walls projecting downward from the top;
at least a pair of holes in each of the sidewalls of the tray at the bottom surface of the tray;
a plurality of product containing packages received in the tray, each package comprising a product suspended by wrapping film on a support having a bottom edge supported by the bottom surface of the tray and having left and right side edges proximate the end walls of the tray;
the packages having notches in the bottom edges aligned with said holes in the sidewalls of the tray and forming passageways in the container for accommodating lifting forks of a fork lift truck to lift the container loaded with the packages in the container and transport the loaded container from one location to another.

19. The apparatus of claim 18 and wherein:
the lid is received on the tray and secured to it.

20. The apparatus of claim 19 and further comprising:
banding securing the lid to the tray, the banding extending through said passageways and under said product containing packages in the tray and up portions of the sidewalls of the tray and the lid and across the top of the lid to secure the lid to the tray and packages in the tray.

21. The apparatus of claim 19 and further comprising:
channels received in said passageways between the sidewalls of the tray.

22. The apparatus of claim 21 and wherein:
said channels are downwardly opening.

23. The apparatus of claim 18, wherein:
said support having a first face and a second face and having a top edge;
said support having at least one lower recess in the bottom edge and at least one upper recess in the top edge;
wherein the product comprises a curved glass panel suspended on the first face of said support, said curved glass panel having a concave back surface;
wherein the wrapping film is received in said recesses;
wherein said wrapping film is stretched between said recesses, around at least a portion of the second face of said support, and around at least a portion of the curved glass panel residing on the first face of said support, said wrapping film holding said curved glass panel against said support and said wrapping film imparting a planar curve to said support that substantially conforms to the periphery of the concave back surface.

24. The package of claim 23 and wherein:
said support has at least two lower recesses;
said support is made of a generally rectangular blank of corrugated fiberboard having a front face sheet and a rear face sheet and a corrugated inner sheet,
said support has a first plurality of cuts in the bottom edge and forming bottom tabs,
the tabs are bent in a direction from the second face toward the first face thereby producing said at least two lower recesses in the bottom edge, the recesses being in the form of notches in the bottom edge with the tabs providing support ledges for the curved glass panel to be packaged; and
said wrapping film is engaged with said tabs as said film is stretched around said support and tabs.

25. The package of claim 23 and wherein:
said support is a material sheet resistant to bending about axes parallel to a line containing said bottom edge.

26. The package of claim 23 and wherein:
said support has forwardly projecting extensions at said side edges thereby providing forwardly projecting panels for resistance of said support to bending about axes parallel to a line containing said bottom edge.

27. The package of claim 23 and wherein:
said support is made of material which is resistant to bending about axes parallel to a line containing said bottom edge and which is resistant to bending about axes perpendicular to said line containing said bottom edge.

28. The package of claim 23 and further comprising:
at least one side recess in each of said side edges; and said wrapping film is received in said side recesses.

29. The packaging of claim 23 and wherein:
said wrapping film is a plastic film.

30. The package of claim 23 and wherein the curved glass panel has a perimeter, and the support has a perimeter, and the film suspends the curved glass panel so that the perimeter of the curved glass panel is within the perimeter of the support.

31. The package of claim 30 and wherein:
said support has at least three lower recesses and at least two upper recesses.

32. The package of claim 30 and wherein:
said curved glass panel is a window for a vehicle.

33. The package of claim 23 and wherein:
said support has at least two lower recesses in the bottom edge.

34. The package of claim 23 and wherein:
said support is made of a generally rectangular blank of corrugated fiberboard having a front face sheet and a rear face sheet and a corrugated inner sheet.

35. The package of claim 23 and wherein:
substantially the entire periphery of said curved glass panel is attached to said support.

36. The package of claim 23 and wherein:
the periphery of said curved glass panel is located proximate to said at least one lower recess and the periphery of said curved glass panel is located proximate to said at least one upper recess.

37. The package of claim 18 and wherein:
the plurality of product containing packages are nested in an "X" configuration wherein half of the packages are oriented in one direction and the other half in the other direction.

38. The package of claim 23 and wherein:
said support has two lower recesses in the bottom edge, each of said lower recesses being sized and positioned to accommodate lifting forks of a fork lift truck.

39. The package of claim 23 and wherein:

said support is made of corrugated fiberboard oriented with the flutes running substantially perpendicular to said top and bottom edges.

40. The package of claim 23 and wherein:

said wrapping film contacts a majority of the width of said curved glass panel.

41. The package of claim 23 and wherein:

said wrapping film is a continuous wrap.

42. The package of claim 23, wherein said wrapping film is wrapped from top to bottom across a majority of the width of the curved glass panel.

43. The package of claim 42, wherein said wrapping film covers the whole width of the curved glass panel.

44. The package of claim 23, wherein said wrapping film covers the entire perimeter of the curved glass panel.

45. The package of claim 23, wherein said support is made of a corrugated fiberboard oriented with flutes running substantially parallel to the axis of curvature of said planar curve.

46. The package of claim 45, wherein said flutes run substantially perpendicular to said top and bottom edges, and the majority of the length of said top and bottom edges are substantially free of scoring or creasing.

* * * * *